US010029454B2

(12) United States Patent
Crozier et al.

(10) Patent No.: US 10,029,454 B2
(45) Date of Patent: Jul. 24, 2018

(54) METHODS AND APPARATUSES FOR PRODUCING A NEWSPAPER COMPRISING ALIGNING PREPRINTED IMAGES TO THE OPERATIONS OF A PRESS AND MODIFYING THE CUTOFF LENGTH OF THE PREPRINTED IMAGES

(71) Applicants: Russell Charles Crozier, Los Angeles, CA (US); Daniel O'Leary, Antelope, CA (US)

(72) Inventors: Russell Charles Crozier, Los Angeles, CA (US); Daniel O'Leary, Antelope, CA (US)

( * ) Notice: Subject to any disclaimer, the term of this patent is extended or adjusted under 35 U.S.C. 154(b) by 0 days.

(21) Appl. No.: 14/925,736

(22) Filed: Oct. 28, 2015

(65) Prior Publication Data

US 2016/0046118 A1 Feb. 18, 2016
US 2018/0147829 A9 May 31, 2018

Related U.S. Application Data

(60) Continuation of application No. 14/483,453, filed on Sep. 11, 2014, now Pat. No. 9,206,012, which is a (Continued)

(51) Int. Cl.
*B41F 13/02* (2006.01)
*B65H 19/10* (2006.01)
(Continued)

(52) U.S. Cl.
CPC ..... *B41F 33/0081* (2013.01); *B41F 5/04* (2013.01); *B41F 7/04* (2013.01); *B41F 13/02* (2013.01); *B41F 13/025* (2013.01); *B41F 13/60* (2013.01); *B41F 23/00* (2013.01); *B65H 19/10* (2013.01); *B65H 19/18* (2013.01); *B65H 19/1821* (2013.01); *B65H 19/1868* (2013.01);
(Continued)

(58) Field of Classification Search
CPC ..... B41F 13/12; B41F 13/52; B41F 13/02; B41F 13/08; B41F 13/10; B41F 13/16
USPC ..... 101/248, 228, 485; 492/21
See application file for complete search history.

(56) References Cited

U.S. PATENT DOCUMENTS 2,522,479 A 9/1950 Crafts
2,599,430 A 6/1952 Beuerman
(Continued)

FOREIGN PATENT DOCUMENTS

EP 1422653 B1 9/2007

*Primary Examiner* — Leslie J Evanisko

(57) ABSTRACT

Systems and methods for aligning preprinted images on a roll of substrate to the moving components of a web press are disclosed. A method in accordance with one embodiment includes determining the speed of the moving components of the press, determining the speed of the web of preprinted images and adjusting the speed of the web of preprinted image to match the speed of the web. In particular embodiments, a press which produces rolls of preprinted material can be modified to change the equivalent cutoff length of the press. In further embodiments, a method of pasting new rolls of material to expiring rolls of material is accomplished by modulating the drive speed of the new roll of material to match the expiring roll of material while at the same time aligning the images on the new roll with the expiring roll.

2 Claims, 16 Drawing Sheets

Related U.S. Application Data division of application No. 13/896,265, filed on May 16, 2013, now Pat. No. 8,893,615, which is a continuation-in-part of application No. 12/724,240, filed on Mar. 15, 2010, now abandoned.

(60) Provisional application No. 61/647,962, filed on May 16, 2012.

(51) Int. Cl.

| | |
|---|---|
| ***B41F 33/00*** | (2006.01) |
| ***B41F 13/60*** | (2006.01) |
| ***B41F 5/04*** | (2006.01) |
| ***B41F 23/00*** | (2006.01) |
| ***B65H 19/18*** | (2006.01) |
| ***B65H 23/185*** | (2006.01) |
| ***B65H 37/04*** | (2006.01) |
| ***B65H 43/02*** | (2006.01) |
| ***B65H 43/06*** | (2006.01) |
| ***B41F 7/04*** | (2006.01) |
| ***B65H 39/16*** | (2006.01) |

(52) U.S. Cl.

CPC ..... *B65H 23/185* (2013.01); *B65H 37/04* (2013.01); *B65H 39/16* (2013.01); *B65H 43/02* (2013.01); *B65H 43/06* (2013.01); *B65H 2301/46013* (2013.01); *B65H 2301/4631* (2013.01); *B65H 2511/512* (2013.01); *B65H 2513/212* (2013.01); *B65H 2801/21* (2013.01)

(56) References Cited

U.S. PATENT DOCUMENTS

| | | | | |
|---|---|---|---|---|
| 2,631,033 | A | 3/1953 | Tollison | |
| 3,058,869 | A | 10/1962 | Cohen et al. | |
| 3,326,436 | A | 6/1967 | Huck | |
| 3,335,928 | A | 8/1967 | Angell | |
| 3,474,311 | A * | 10/1969 | Lewis, Jr. ..... | B65H 23/1882 101/181 |
| 3,899,946 | A * | 8/1975 | Niepmann ..... | B26D 5/24 101/226 |
| 4,096,801 | A | 6/1978 | Martin | |
| 4,147,078 | A | 4/1979 | Bishop | |
| 4,264,957 | A * | 4/1981 | Pautzke ..... | B41F 13/025 101/248 |
| 4,380,943 | A | 4/1983 | Evans | |
| 6,015,182 | A | 1/2000 | Weissert et al. | |
| 6,053,107 | A | 4/2000 | Hertel | |
| 2003/0084765 | A1 | 5/2003 | Elkotbi | |
| 2005/0166744 | A1 | 8/2005 | Berge et al. | |
| 2007/0051161 | A1 | 3/2007 | Friedman | |
| 2011/0203469 | A1 * | 8/2011 | Deis ..... | B41F 13/10 101/415.1 |

* cited by examiner

METHODS AND APPARATUSES FOR PRODUCING A NEWSPAPER COMPRISING ALIGNING PREPRINTED IMAGES TO THE OPERATIONS OF A PRESS AND MODIFYING THE CUTOFF LENGTH OF THE PREPRINTED IMAGES

The present application herein incorporates by reference in its entirety U.S. Non-Provisional application Ser. No. 14/483,453, file date Sep. 11, 2014.

The present application herein incorporates by reference in its entirety US Patent Application Publication 2015-0008634 A1, published on Jan. 8, 2015.

The present application herein incorporates by reference in its entirety U.S. Non-Provisional application Ser. No. 13/896,265, file date May 16, 2013.

The present application herein incorporates by reference in its entirety US Patent Application Publication 2013-0255518 A1, published on Oct. 3, 2013.

The present application herein incorporates by reference in its entirety U.S. Non-Provisional application Ser. No. 12/724,240; file date Mar. 15, 2010.

The present application herein incorporates by reference in its entirety U.S. Patent Application Publication 2011-0219976 A1, published on Sep. 15, 2011.

The present application incorporates by reference in its entirety U.S. Provisional Patent Application No. 61/647,962; file date May 16, 2012.

TECHNICAL FIELD

Aspects of the present disclosure are directed to systems, methods and apparatuses for aligning preprinted images on rolls of substrate to the moving components of a web printing press, for example by measuring the relative position of the preprinted image to the cutoff blade and then adjusting the relative position to a desired relative position.

BACKGROUND

As newspapers continue to struggle for advertising dollars, newspaper publishers are constantly searching for new methods of attracting advertisers. Newspapers are generally printed on inexpensive paper on cold set web printing presses. The substrate, or paper, is printed with an ink which sets, or dries, in a very short amount of time. This process produces an inexpensive product but also a relatively low quality product. Higher quality publications can be inserted into a newspaper subsequent to folding and cutting. These higher quality inserted publications are frequently discarded by the reader for many reasons. They are often grouped together with a substantial amount of other advertising in which the reader may or may not be interested and the reader will not wish to take the time to sift through all of the inserted material to see if there is something of interest. There are many levels of printing quality and inserted material is sometimes higher quality than newsprint, but generally not of a high quality that would attract higher end advertisers. High quality printing requires a printing process which is very different from the cold set web printing process. High quality printing can be slower and require heat or some process to set the large amount of ink applied to the substrate.

Advertisers would like to have high quality glossy ads which appear within the pages of a newspaper and not inserted subsequent to folding and cutting. These high quality images cannot be printed on a cold set web printing press. A need exists for a printing process which includes high quality images interleaved with the low quality images appearing within the pages of a newspaper

DETAILED DESCRIPTION

The present disclosure is directed generally to systems, methods and apparatuses for aligning preprinted images on rolls of substrate to the moving components of a web printing press. Several details describing structures or processes that are well-known and often associated with such systems, methods and apparatuses are not set forth in the following description to avoid unnecessarily obscuring the description of the various embodiments of the disclosure. Moreover, although the following disclosure sets forth several embodiments, several other embodiments can have different configurations or different components than those described in this disclosure. In particular, other embodiments may have additional elements or may lack one or more of the elements described below with reference to FIGS. 1-10. Many of the elements are not drawn to scale for purposes of clarity and/or illustration.

Many embodiments of the disclosure may take the form of computer-executable instructions, including routines executed by a programmable, special-purpose computer. Those skilled in the relevant art will appreciate that embodiments of the disclosure can be practiced on computer systems other than those shown and described below. Aspects of the disclosure can be embodied in a special purpose computer or data processor that is specifically programmed, configured or constructed to perform one or more of the computer-executable instructions described below. Accordingly, the terms "computer" and "controller" as generally used herein refer to any appropriately configured data processor and can include Internet appliances and hand-held devices, including palm-top computers, wearable computers, cellular or mobile phones, multi-processor systems, processor-based or programmable consumer electronics, network computers, minicomputers and the like. Information handled by these computers can be presented at any suitable display medium, including a CRT display or an LCD.

Aspects of the disclosure can also be practiced in distributed environments, where tasks or modules are performed by remote processing devices that are linked through a communications network. In a distributed computing environment, program modules or subroutines may be located in local and remote memory storage devices. Aspects of the disclosure described below may be stored or distributed on computer-readable media, including magnetic or optically readable or removable computer disks, as well as distributed electronically over networks. In particular embodiments, instructions and/or other aspects of the disclosure are carried by or included in data structures and transmissions.

Figure 1:
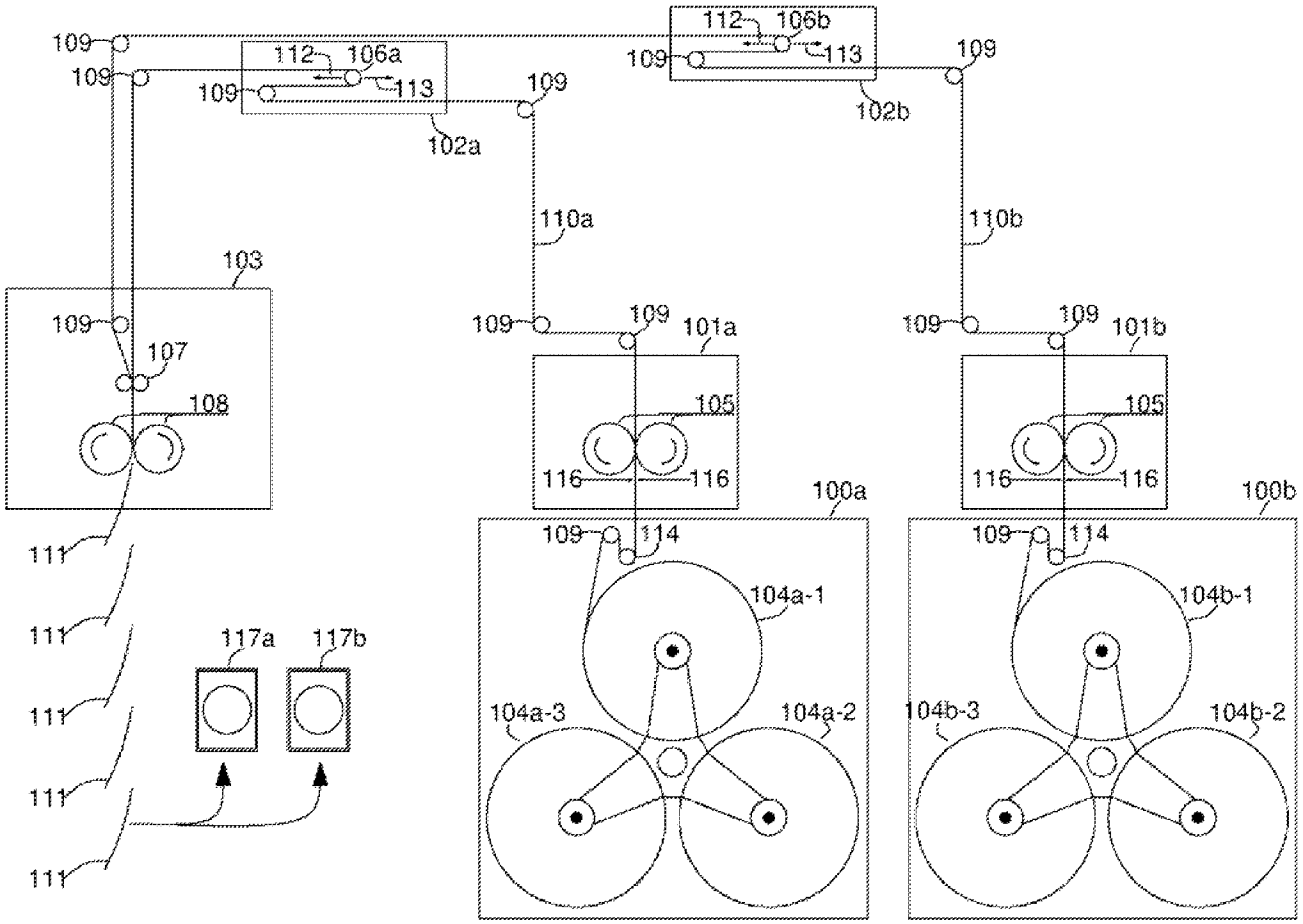
Fig. 1 Prior Art
FIG. 1 is an illustration of a prior art web printing press.

FIG. 1 is an illustration of a prior art web printing press well know to those skilled in the art. Web printing presses are manufactured with a wide variety of features and components. FIG. 1 depicts a web press with two webs 110*a* and 110*b*. Other web presses can include more or fewer webs. In some embodiments, web presses can include infeed sections 100*a* and 100*b*, printing units 101*a* and 101*b*, compensators 102*a* and 102*b* and a folder 103. The infeed section illustrated in FIG. 1 includes three rolls of unprinted substrate. Other infeed sections can have more or fewer rolls of unprinted substrate. Prior art infeed sections can include festoon's as well as many other methods of feeding the substrate to the web press. Infeed section functions include providing substrate to the web press, maintaining web tension as well as other functions. Print units 101A and 101B can include offset print cylinders as well as other types of print cylinders. Print units 101A and 101B illustrate units with two print cylinders. Other embodiments of print units can have more or less than two print cylinders. Print cylinders can print a variety of colors onto a substrate. Compensators 102*a* and 102*b*, illustrated in FIG. 1, adjust the length of a web between the print unit and the folder. Adjustment in web length changes the distance an image travels from the print unit to the folder. The adjustment in web length also changes the amount of time required for an image to travel from the print unit to the folder. Changes in web length allows the press operator to adjust the compensator so that the cutoff knife cuts the web in between images, resulting in the desired result of a full image on each page. Compensators on each web are individually adjusted to time the arrival of a new image to the folder and cutoff knife. A desired arrival timing can result in the cutoff knife cutting the stacks of webs in between images, resulting in each page being a full, page including margins within the specification of the publisher.

Figure 2:
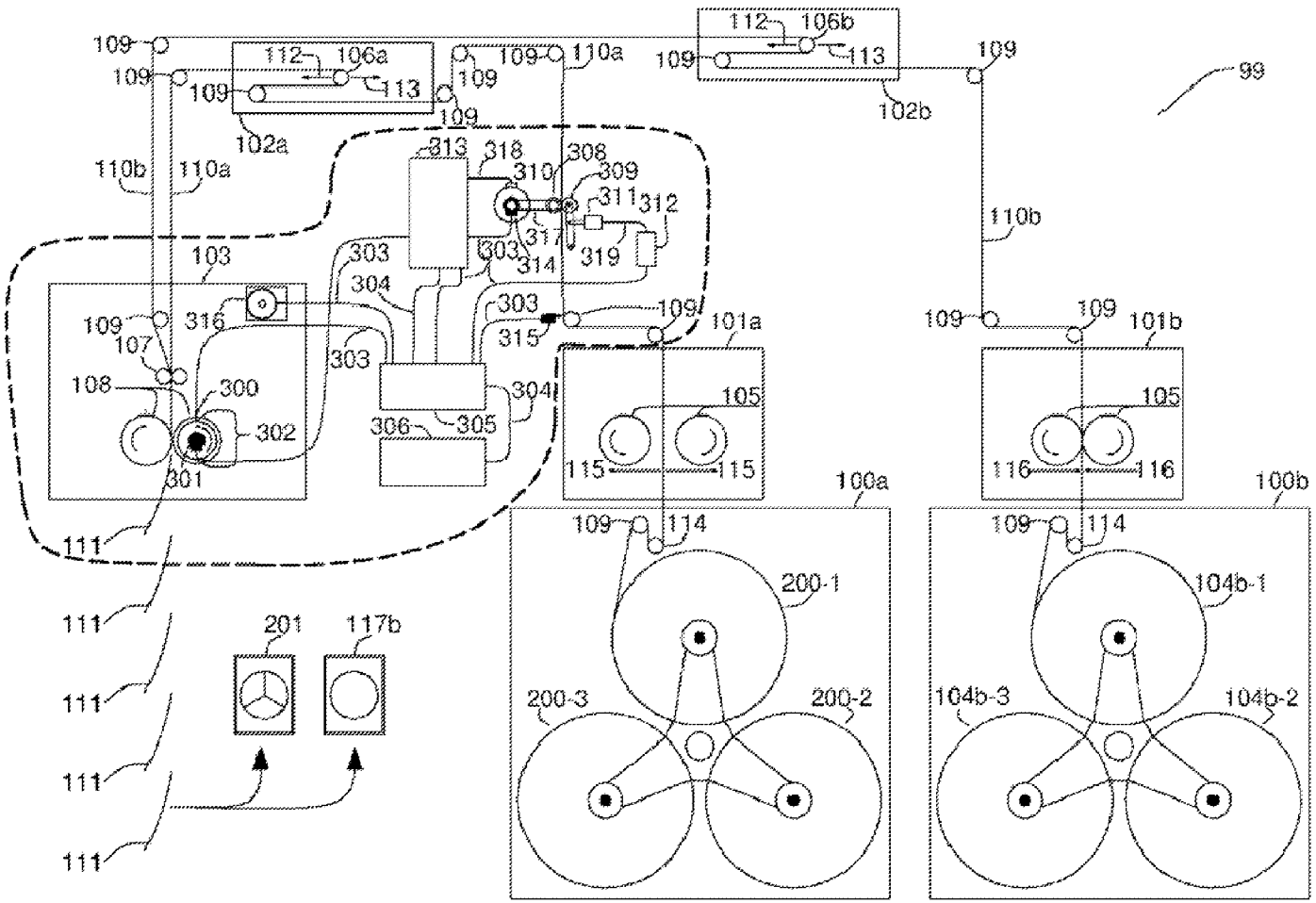
FIG. 2 is an illustration of a web printing press having an Alignment Control System in accordance with several embodiments of the disclosure.

FIG. 2 is a partially schematic illustration of a web printing press 99 configured in accordance with an embodiment of the disclosure. Web press 99 includes an Alignment Control System (ACS). An ACS can include hardware, software and computerized controllers. In the particular embodiment illustrated in FIG. 2 an ACS can comprise a CPU 305, user interface 306, variable speed drive module (VSDM) 313, motor 310, Alignment Roller 308, Nip Roller 309 and a sensor suite. A VSDM powers motor 310. Motor 310 drives Alignment Roller 308 with drive belt 317. Nip roller 309 presses against Alignment Roller 308. Web 110*a* passes between Alignment roller 308 and nip roller 309.

VSDM 313 is configured for electronic line shaft operation, which requires signals from master encoder 301 and slave encoder 314. VSDM 313 is configured to maintain a base-line ratio between master encoder signal 301 and slave encoder signal 314. The base-line ratio is the ratio that can match the surface speed of the Alignment Roller 308 and the surface speed of cut off roller 108.

If the speed of motor 310 is outside of predetermined tolerances drive module 313 can adjust the speed of motor 310 until the measured speed is within a predetermined tolerance. A predetermined tolerance can be calculated for each installation of an embodiment and can include factors such as slop in the mechanisms of the press, tolerance of the images printed on the existing press, accuracy of measuring position and speed of the press as well as many other factors which can be dependent upon the details of a given press.

VSDM 313 communicates with CPU 305. CPU 305 can receive signals from sensor 315. Signals from sensor 315 can be used to determine speed and position of the preprinted images on web 110*a*. CPU 305 can receive signals from sensor 300 which can be used to determine speed and position of the cutoff knife. CPU 305 can receive signals from a press pulse generator 316. CPU 305 can use these signals to determine whether the images on the preprinted roll of substrate can arrive at the knife on the cutoff cylinder at the proper time. The proper time is determined from many factors which include the tolerance of the existing press as well as many other web specific factors. Generally, the proper time between the pulses can result in the cutoff knife cutting the web between the images within an acceptable tolerance.

The particular embodiment illustrated in FIG. 2 locates the Alignment Roller 308 and some of its associated components between print unit 101*a* and compensator 102*a*. Other embodiments can include an Alignment Roller and some of its associated components located between compensator 102*a* and folder 103.

The particular embodiment illustrated in FIG. 2 presents an Alignment roller which is added to a web press. Other embodiments can utilize rollers which are part of an existing web press including print rollers and outfeed drive rollers to perform the functions of an Alignment Roller. These embodiments would require the appropriate modifications to allow the existing components to be perform the functions of an Alignment Roller.

Web press 99 can include an infeed section which can comprise infeed sections 100*a* and 100*b*. Infeed 100*a* can comprise rolls of preprinted substrate 200-1, 200-2 abd 200-3. The rolls of preprinted substrate can be threaded through the web press and can create webs of substrate.

Web press 99 can include printing units 101*a* and 101*b*. Print unit 101*a* illustrates a print unit with two cylinders 105 moved away from the substrate. When print cylinders are moved away from each other this is known a impression off position. The impression off position atlows the substrate to pass between the cylinders without contacting the cylinders.

Web press 99 can include compensators 102*a* and 102*b*, which are capable of modifying the length of the web. Some publishers can desire the ability to maintain the functionality of the compensators. The ACS can be configured to functions in harmony with the web press existing compensators. Other printers may desire the ACS to perform the functions of the compensator. The ACS can be configured to perform the functions of the compensator, and can obviate the requirement for a compensator as illustrated in FIG. 2.

Figure 3:
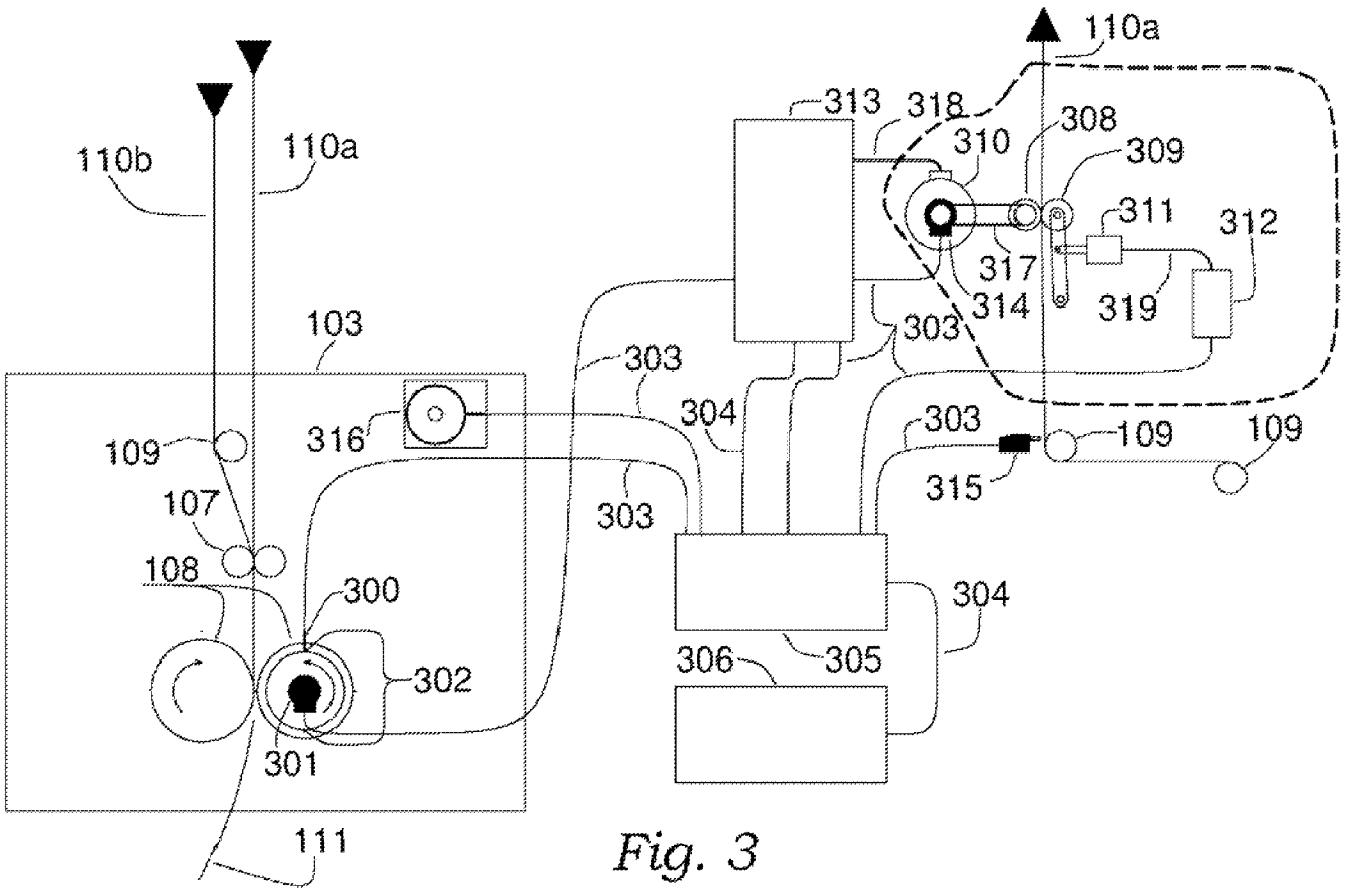
FIG. 3 is an enlarged illustration of a portion of a web printing press presented in FIG. 2 in accordance with several embodiments of the disclosure.

FIG. 3 is an enlarged view of the portion of FIG. 2 enclosed within the dashed line. FIG. 3 illustrates web 110*a* passing over guide rollers 109, in between Alignment Roller 308 and nip roller 309. Web 110*a* is also shown entering into folder 103 and passing between cutoff cylinders 108.

Electronic line shafting is controlled by VSDM 313 which can receive signals from encoders 301 and 314. In this particular embodiment, the signals are represented being communicated to the VSDM 313 via wires 303. Other embodiments can include signals communicated wirelessly as well as any other method of communicating signals well known to those skilled in the art.

CPU 305 can receive signals from sensors 315 and 300 as well as from press pulse generator 316. CPU 305 functions can include counting the number of press pulses occurring between signals from sensors 315 and 300. If the number of pulses is outside the allowable range of pulses, a signal can be sent from CPU 305 to VSDM 313 to adjust the position of the web by modulating the speed of Alignment Roller 308. When the number of pulses occurring between signals from sensors 315 and 300 is within the allowable range, CPU 305 does not send a signal to VSDM to modulate the speed of Alignment Roller 308.

Operator Interface panel 306 can communicate information to an operator. Information can include whether the system is on or off, if the preprinted images are aligned to the moving parts of the press and can also be customized to provide specific information desired by an operator.

The human/machine interface can be accomplished by means of conventional, discrete switches, push buttons, gauges, meters, manual numeric entry devices, industrial touch screen or computer screen with all discrete control, data entry and data display executed via programmable virtual devices or it may be accomplished by a combination of these technologies.

Figure 4B:
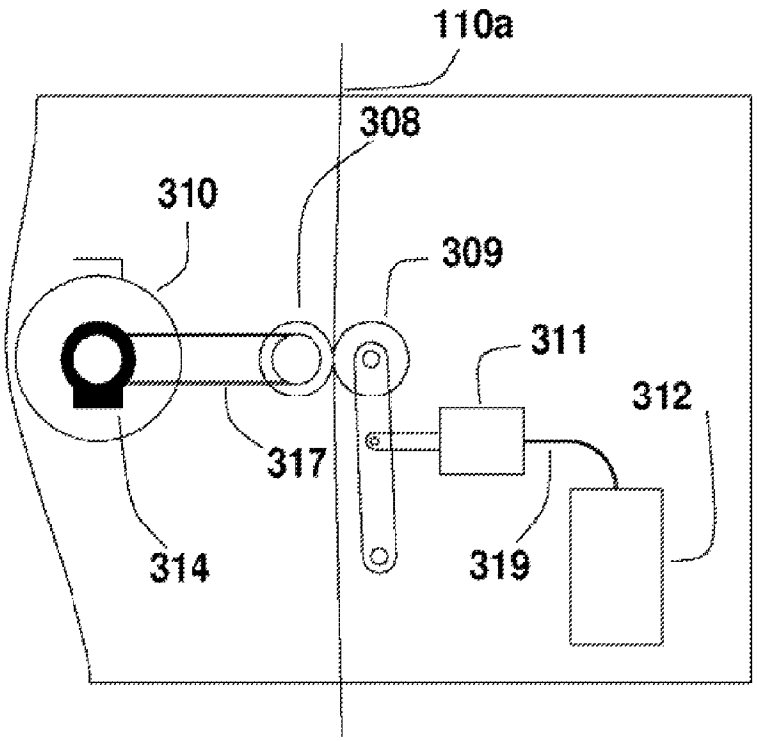
FIG. 4B is an enlarged illustration of a portion of a web printing press illustrated in FIG. 3. This particular embodiment has the Alignment Roller engaged with the web in accordance with an embodiment of the disclosure.
Figure 4A:
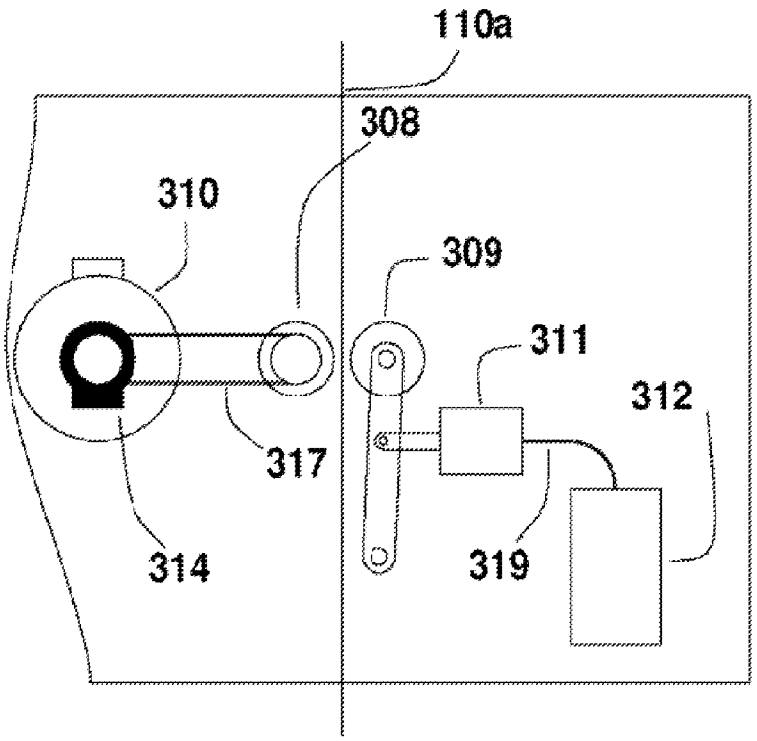
FIG. 4A is an enlarged illustration of a portion of a web printing press illustrated in FIG. 3. This particular embodiment has the Alignment Roller disengaged from the web in accordance with an embodiment of the disclosure.

FIG. 4 is an enlarge view of the portion of FIG. 3 enclosed within the dashed line. In this particular embodiment, encoder 314 is mounted on motor 310. Other embodiments can have encoder 314 mounted in other locations. Alignment Roller 308 is driven by belt 317. Other embodiments can have Alignment Roller 308 driven by gears, pulleys or any other acceptable method familiar to those skilled in the art. Nip roller 309 is not pressing against Alignment Roller 308 in FIG. 4A. When the nip roller is not contacting the Alignment Roller, the web passes between them without contacting the rollers. This position can allow the press to operate without the influence of the ACS.

FIG. 4B illustrates the nip roller 309 pressing against the Alignment Roller 308. In this particular embodiment, the nip roller 309 is pressed against Alignment Roller 308 by actuator 311. Actuator 311 is driven by controller 312. In other embodiments, there can be other actuators configured differently than depicted in FIG. 4. Actuators types can include hydraulic, pneumatic and electric.

In another particular aspect of the disclosure, preprinted images may be produced by web presses which have page lengths which are different from the web press the preprinted images are being threaded into. The distance measured from the beginning of one image to the beginning of the next image occurring on the web is typically referred to as the cutoff of the press. The cutoff of a press with an ACS installed will be referred to as the resident press cutoff. There can be variations in the cutoff lengths between presses. The cutoff length of the particular embodiment of the press illustrated in FIG. 2 is not equal to the distance between successive images on the preprinted roll.

The distance from the beginning of one preprinted image to the beginning of the next successive preprinted image is equal to the cutoff of the press which produced the preprinted roll. Since the roll is not cut, the distance between the start of two successive images will be referred to as the equivalent cutoff. The ACS can successfully align images with an equivalent cutoff which is not equal to the resident press cutoff. The amount of difference between the cutoff and equivalent cutoff which can be aligned differs from press to press and includes factors such as age of the press, backlash, top and bottom margins as well as many other press dependent factors.

If the ACS cannot properly align the preprinted images because the difference between the equivalent cutoff and the web press cutoff is too great the process which creates the preprinted image can be altered to produce a product which the ACS can successfully align.

Figure 5A:
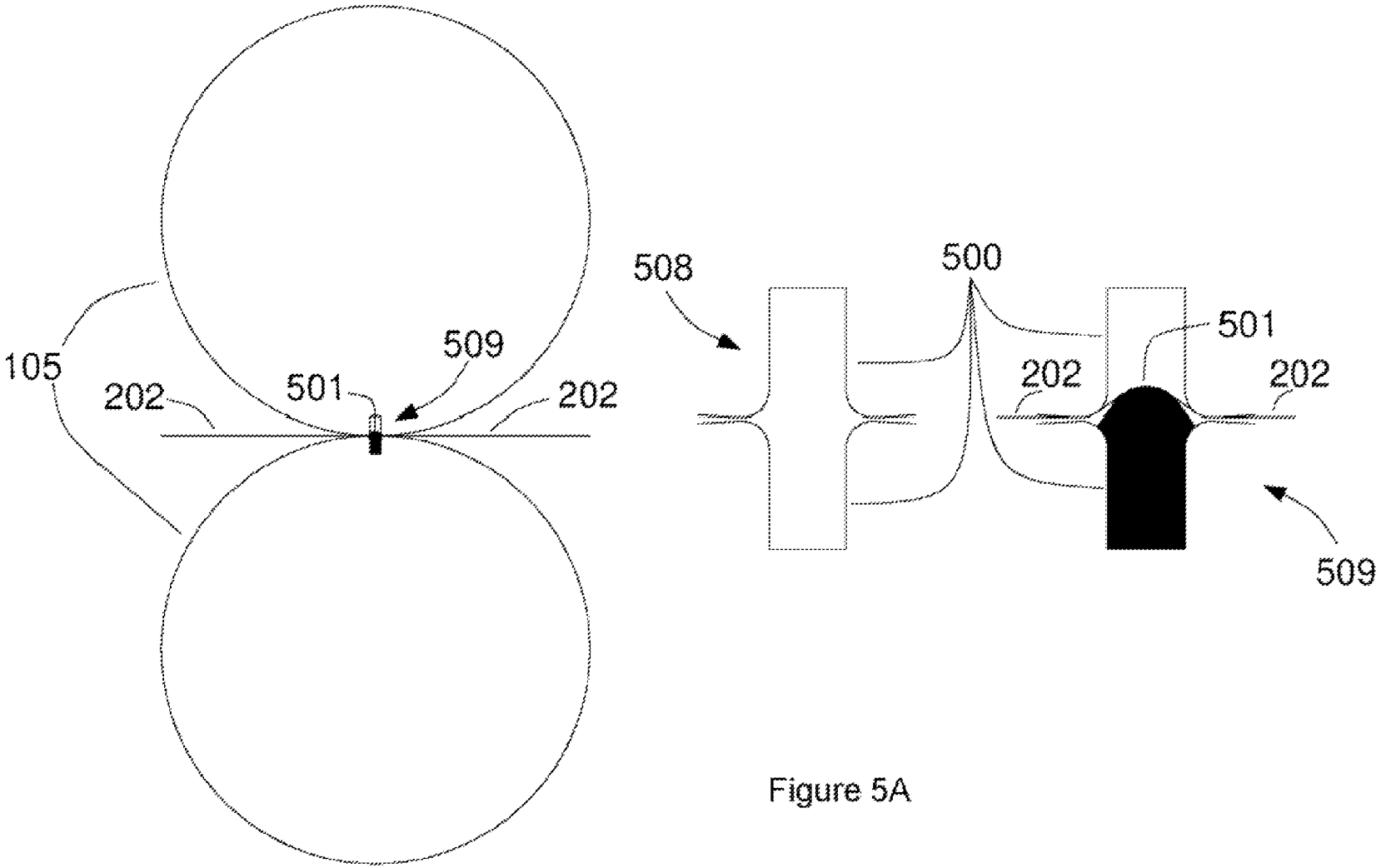
FIG. 5A illustrates a potential embodiment of a kerf strip installed into a blanket roller in accordance with an embodiment of the disclosure.

FIG. 5A illustrates an aspect of the disclosure which can provide an increased equivalent cutoff. The press creating rolls of preprinted images can include kerf strips 501 installed on the print cylinders. The kerf strip increases the circumference of the print cylinder, increasing the equivalent cutoff.

Figure 5B:
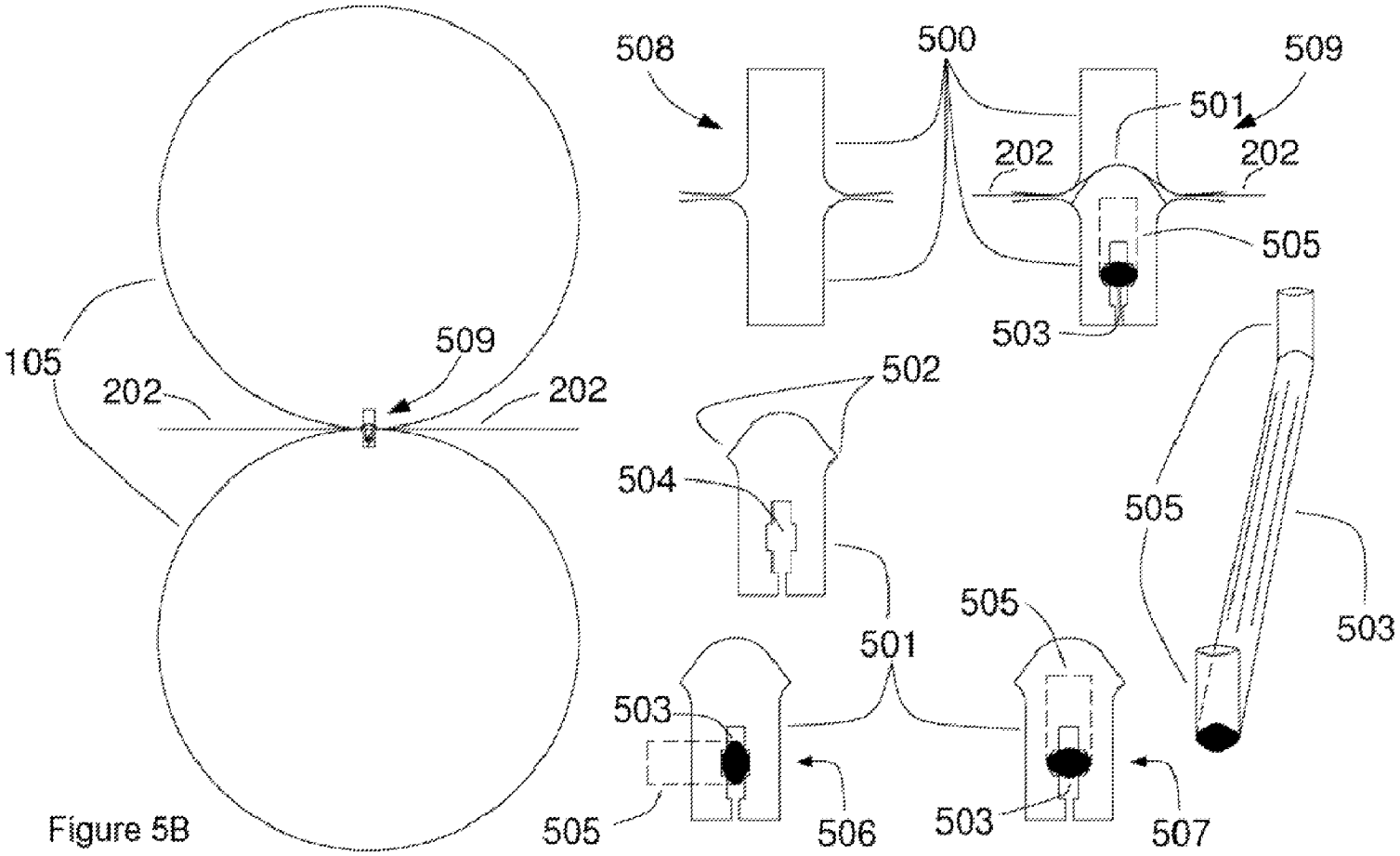
FIG. 5B illustrates a kerf strip and a kerf strip locking mechanism installed into blanket cylinders in accordance with an embodiment of the disclosure.

FIG. 5B illustrates a particular embodiment of kerf strips 501. Kerf strip 501 can be secured into print cylinder 105 with lock bar 503. Lock bar 503 can include handles 505 at either end. Rotating handles 505 can expand the base of kerf strip 501 creating a friction fit inside slot 508.

Figure 5C:
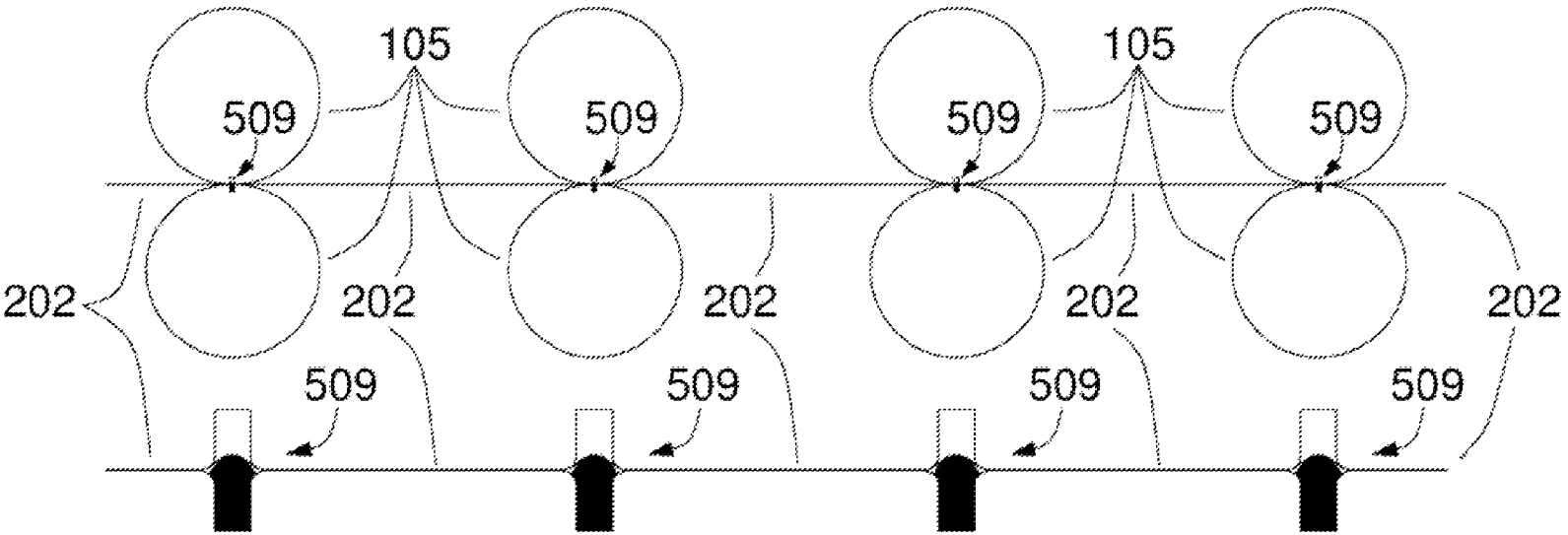
FIG. 5C illustrates kerf strips installed into a series of blanket cylinders in accordance with an embodiment of the disclosure.

FIG. 5C illustrates a particular embodiment of the disclosure in which the print unit producing the rolls of preprinted images has multiple print cylinders. Each pair of print units would include a kerf strip. In a particular aspect of the invention, each of the kerf strips on each of the pairs of cylinders could be identical. Other embodiments of the disclosure can include kerf strips 501 on some print cylinders 105 and exclude kerf strips 501 on other print cylinders 105. The determination of the number of kerf strips 501 and the specific geometry of the kerf strips 501 is determined by the specific web press producing the images and the amount of increase in equivalent cutoff which is desired.

Other embodiments of the disclosure to increase the equivalent cutoff include stretching the substrate during the printing process. The stretching of the substrate during the printing process to create an equivalent cutoff which is greater than the cutoff of the press which is creating the preprinted images can be accomplished through a variety of methods. The method chosen to stretch the images is dependent upon many factors. Generally, the substrate can be stretched when it is the most compliant in the printing process. A particular embodiment of the disclosure is the utilization of rollers which can have a higher surface velocity than the surface velocity of the print cylinders. These higher surface velocity rollers can stretch the substrate subsequent to printing and can increase the equivalent cutoff.

The number of higher velocity rollers, the speed of the higher velocity rollers and the location of the higher velocity rollers is dependent upon many specifics of the web press creating the rolls of preprinted images. Each press can have a unique installation to stretch the substrate. Subsequent to printing and stretching, the preprinted rolls can also be rerolled in the stretch condition and stored at a specific temperature profile in order to set the stretch in the image. The specific tension in the roll when rerolled and, the temperature at which the roll is stored and the time between printing and rerolling are determined by specific implementation of these potential embodiments of the disclosure.

Figure 6A:
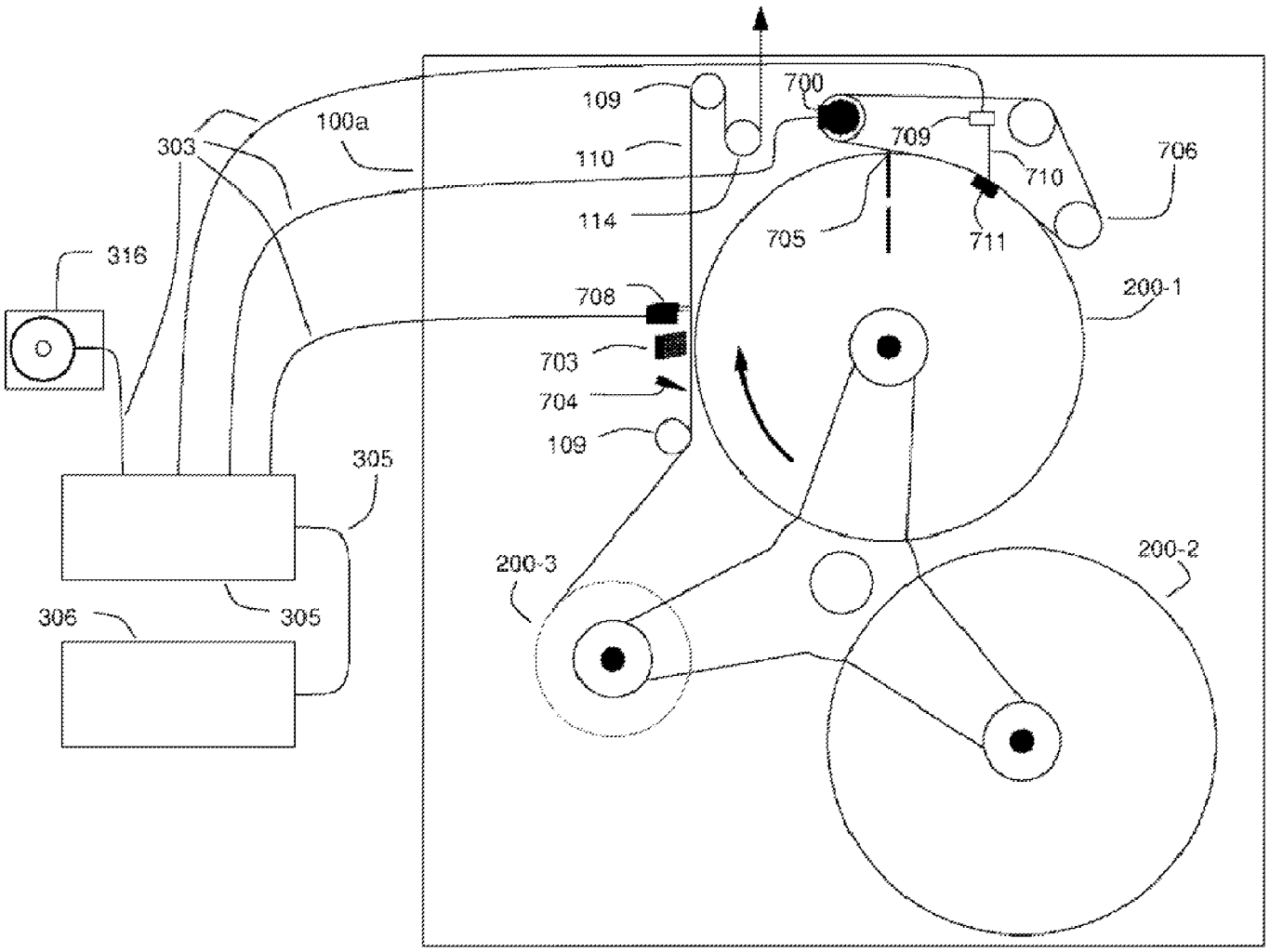
FIG. 6A is an enlarged illustration of a portion of press comprising an infeed section and some components of an Alignment Control System in accordance with several embodiments of the disclosure.

FIG. 6A illustrates a particular embodiment of the disclosure of an Aligned Paste System (APS) and some components of an infeed section and some components of a Reel Tension Paster (RTP). An APS can include an expiring roll timing mark sensor 708, a new roll leading edge sensor 709, a new roll belt drive encoder 700 and a press pulse generator 316, a CPU 305 and a user interface 306. CPU 305 can receive signals from sensor 708. Signals from sensor 708 can be used by CPU 305 to calculate the speed and position of the images on the expiring roll 200-3. CPU 305 can receive signals from sensor 709. In a particular embodiment, sensor 709 can include a paste mark sensor which can emit a light beam 710. Light beam 710 can be reflected from paste mark 711 back to sensor 709. In other embodiments, other sensors can be utilized to sense the section of the new roll which can be pasted to the expiring roll. A particular embodiment may sense the area of the new roll to be pasted at the actual area on the new roll which will be pasted. Other embodiments can sense the new roll paste area at another location on the new roll which is away from the area to be pasted.

In a particular embodiment, an APS can include a CPU 305 which can determine the speed and position of the images on an expiring roll. CPU 305 can determine the speed and position of the images on the new roll. CPU 305 can calculate the speed and position of the paste area on the new roll. CPU 305 can modulate the acceleration of the new roll so that when a pasting of a new preprinted roll to an expiring preprinted roll occurs, the new images are in alignment with the expiring images.

Press and material position and speed sensors may be of any available applicable technology type, including but not limited to inductive proximity sensors, capacitive proximity sensors, optical detection sensors, optical contrast sensors, ultrasonic sensors, absolute position encoders, relative position encoders, registration mark detection cameras, high speed image scanners, or any other technology capable of producing precision signals relative to press and image speed and position.

Some presses may have existing sensors which can provide some or all of the data required by the APS. Other presses may not include sensors which provide information required by the APS. If presses do not have the required sensors, sensors should be added to the press in order to acquire the data required to perform an aligned paste. Selection of the appropriate sensors for an installation of an APS can be influenced by the existence or absence of appropriate signal sources already on a particular press design as well as the type of infeed section and paster of the press. The RTP illustrated in FIG. 6A is one of many different pasters in existence.

Figure 6B:
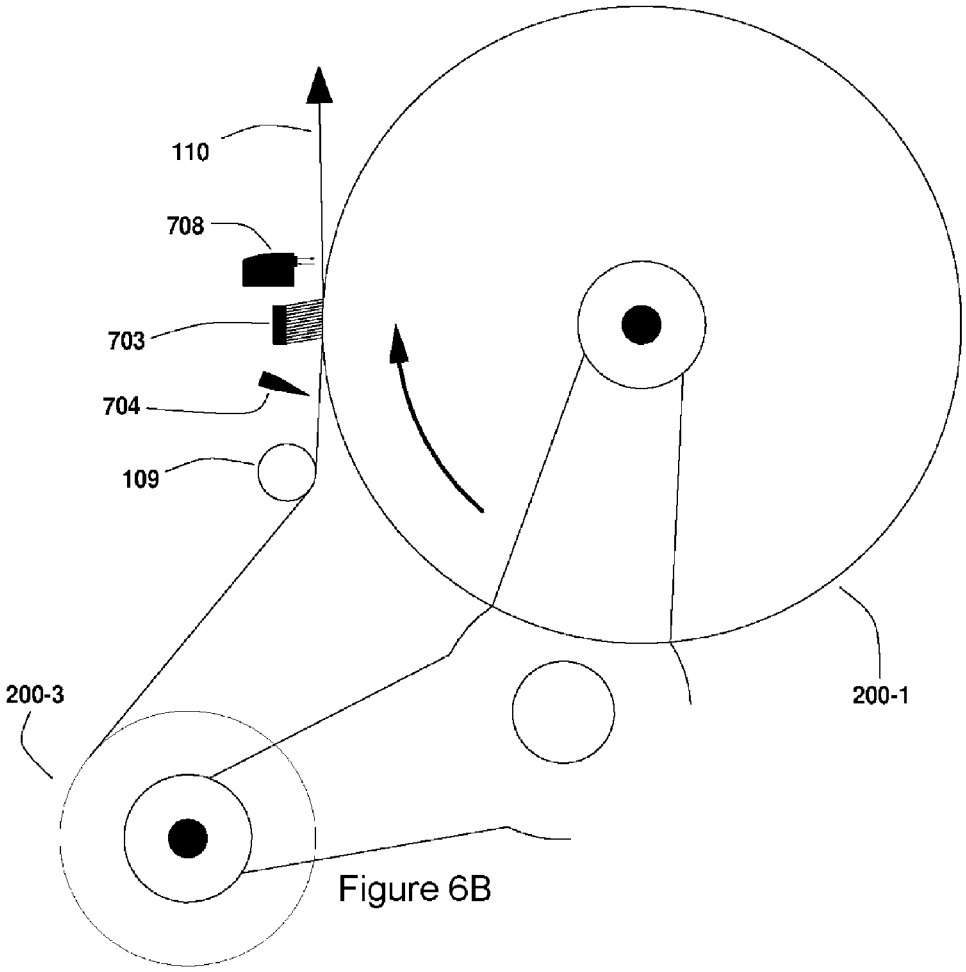
FIG. 6B is an enlarged illustration of an embodiment of a reel tension paster including an expiring roll, a new roll and an expiring roll preprinted image sensor in accordance with several embodiments of the disclosure.

FIG. 6B illustrates a particular embodiment of a paster with paster brush 703 pushing the web 110 from the expiring roll of preprinted material 200-3 against the new roll of preprinted material 200-1. With the brush in this position, the adhesive on the leading edge of the new roll of preprinted material 200-1 can stick to the expiring roll preprinted material 200-3. The leading edge of the new roll of material can peel away from the new roll and be drawn into the press by the material from the expiring roll.

Figure 6C:
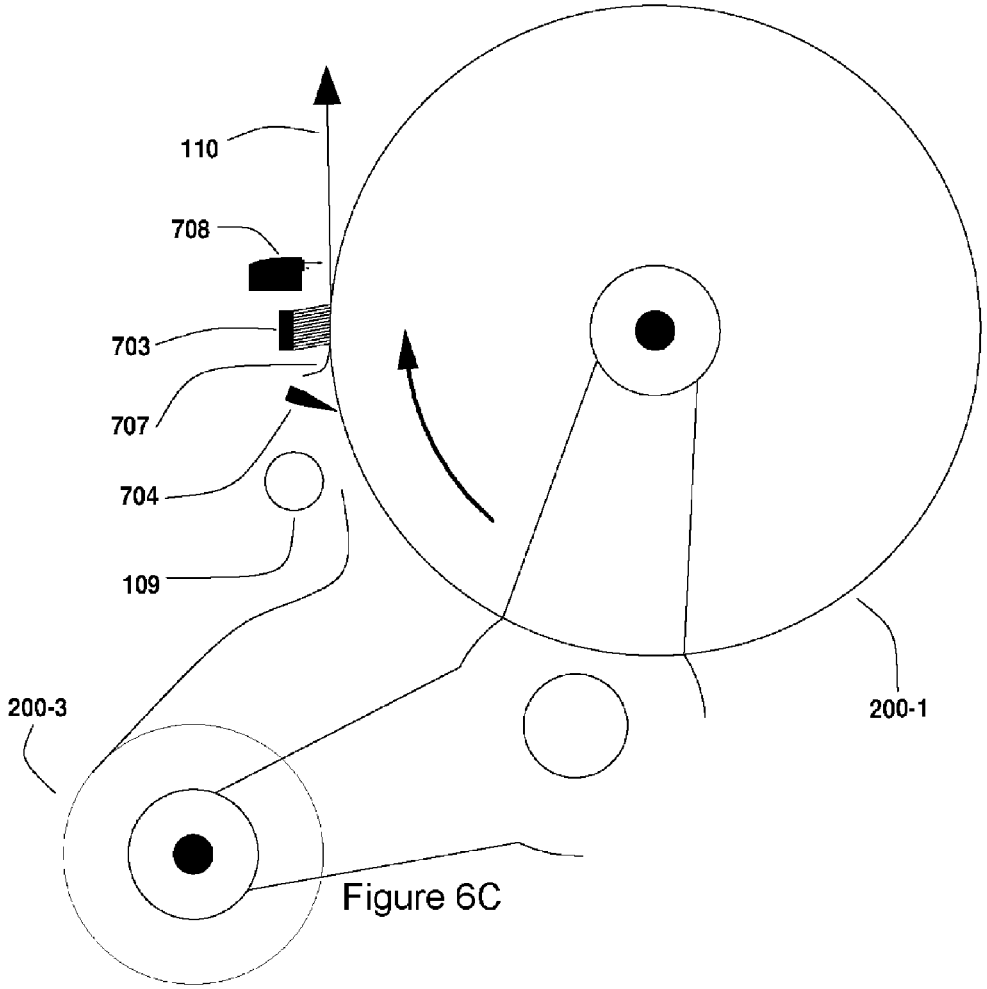
FIG. 6C is the enlarged illustration of FIG. 6B with the cutoff knife engaging the expiring roll substrate in accordance with several embodiments of the disclosure.

FIG. 6C illustrates a particular embodiment of a paster with a paster knife 704 pushed through the expiring web of material after the new roll leading edge 705 has been pasted to the expiring material completing the pasting process.

Figure 7:
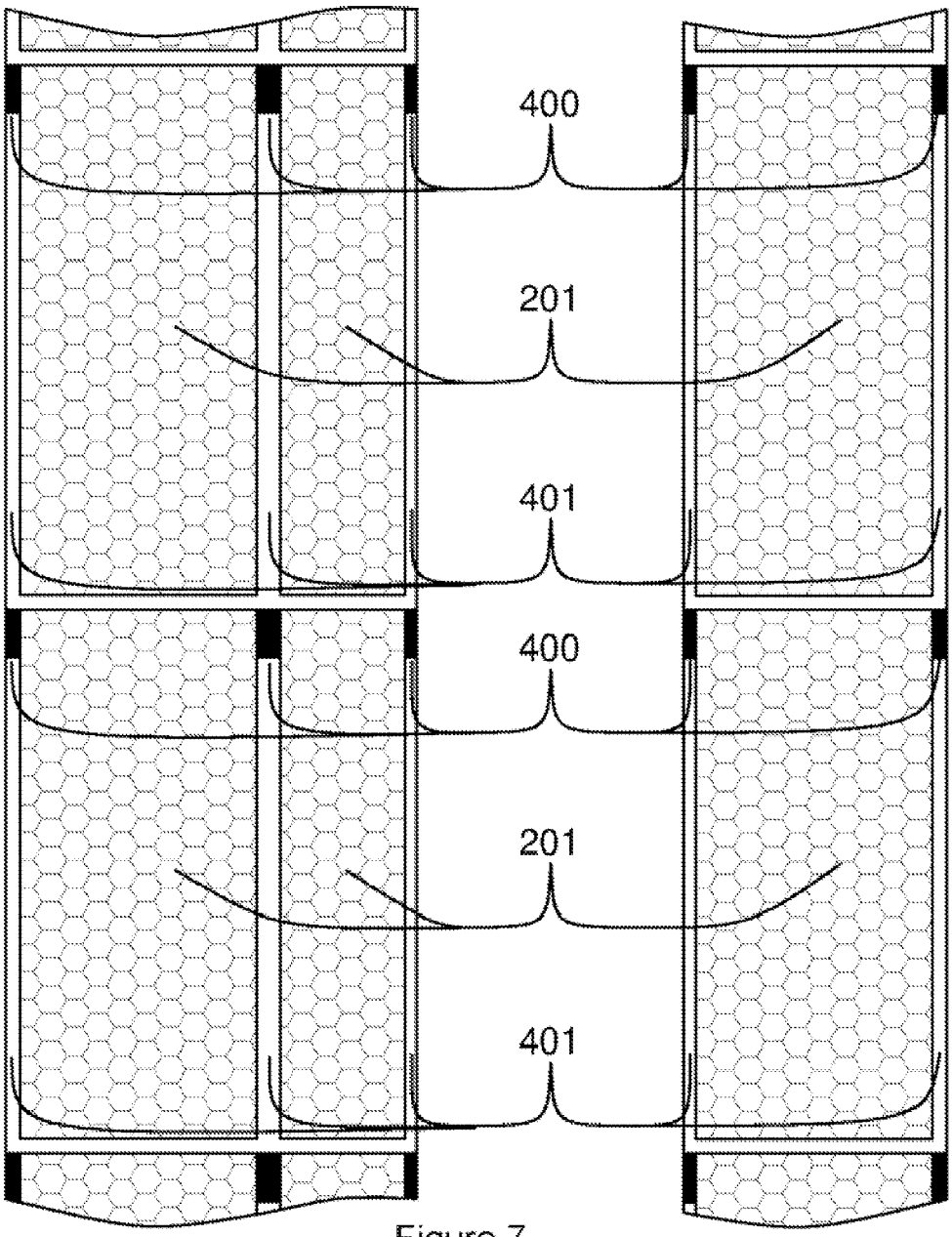
FIG. 7 is an illustration of a portion of a web having preprinted images and timing marks in accordance with several embodiments of the disclosure.

FIG. 7 illustrates a particular embodiment of a preprinted page. The preprinted page can include printed areas 201 which can include pictures, text and any other images which a printer may desire to print. The preprinted page can also include timing marks which can be added to areas of the substrate where text and pictures would not exist. Timing marks such as these can be easily detected by optical sensors. Sensors can then communicate the arrival of the timing mark passing in front of the sensor to a CPU. Other embodiments of timing marks can be included in other preprinted material. Some embodiments may include a magnetic ink which can be sensed by a magnetic sensor. Still other embodiments can have sensors which can scan a web for an area which has no printing for a certain distance. This could be interpreted as the horizontal margin which is normally where a cutoff knife would cut the substrate into individual pages in the folder.

Figure 8A:
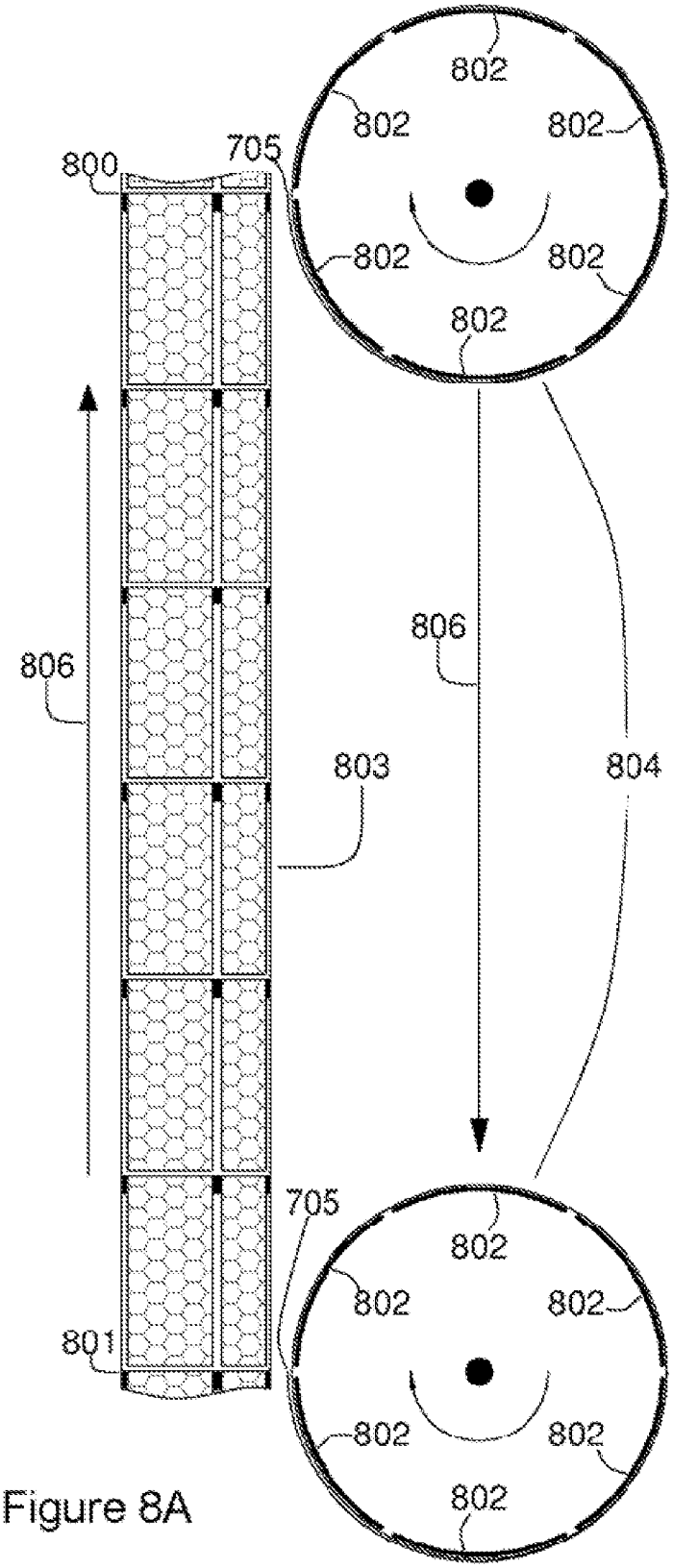
FIG. 8A is an illustration of an exact size image new roll and a length of substrate from the expiring roll in accordance with an embodiment of the disclosure.

FIG. 8A illustrates and expiring web of substrate 806. In a particular embodiment, the expiring web can also include timing marks similar to those described in FIG. 7. FIG. 8A illustrates a new roll 804 of preprinted material exactly six full images 802 in circumference. The new roll 804 has a surface speed which is close enough to the expiring roll material speed to allow pasting to occur without tearing the web. FIG. 8A illustrates that an exact image circumference roll can stay in alignment with the expiring roll material is the surface speed of the new roll is close enough to the speed of the expiring material to allow pasting.

Generally, presses with pasters similar to those depicted in FIG. 6A can measure the speed of the expiring roll and the surface speed of the new roll. When those speeds are similar, a paste can occur without breaking the web. The tolerance range of acceptable speeds is press dependent. The surface speed of the new roll which is within the range of allowable speeds to perform a paste is known as paste speed.

The relative direction vectors 806 show the change in position of the expiring roll material and the new roll from time zero 800 to time one 801. At time zero 800 the new roll leading edge 705 is aligned with an image on the expiring roll material 803. At time one 801, one full revolution of the new roll 804 later, the new roll leading edge 705 is aligned with the image six images further along the expiring roll material 803.

Figure 8B:
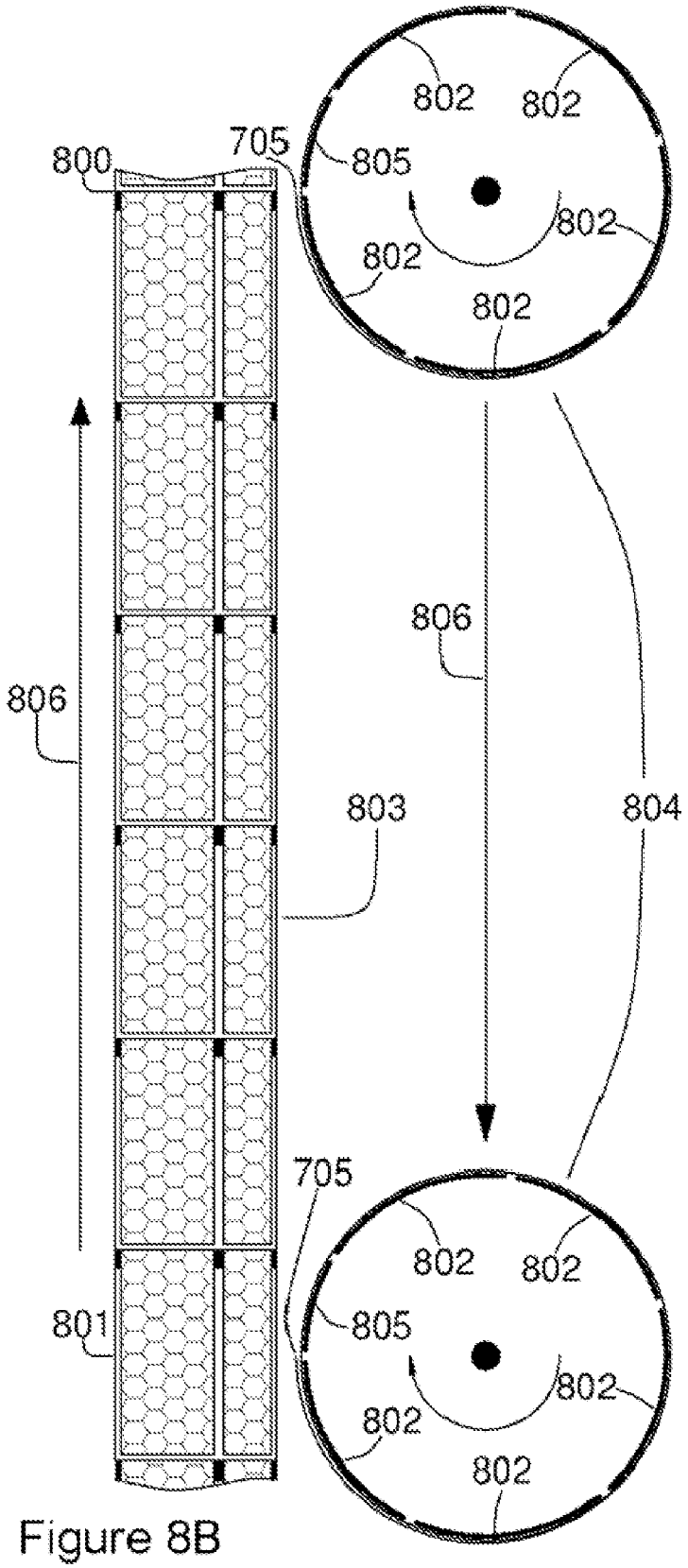
FIG. 8B is an illustration of a non-exact size image roll and a length of substrate from the expiring roll in accordance with an embodiment of the disclosure.

FIG. 8B shows an example of a new roll 804 of preprinted material that is not an exact image circumference roll. In this case it is five full images 802 plus a half image 805 in circumference. This figure illustrates that a roll of material that is not an exact image circumference roll cannot stay in alignment with the images of an expiring roll if the surface speed of the new roll is close enough to the expiring roll speed to achieve pasting. In one rotation, this new roll 804 is a half image out of alignment with the expiring roll material 803.

Figure 8C:
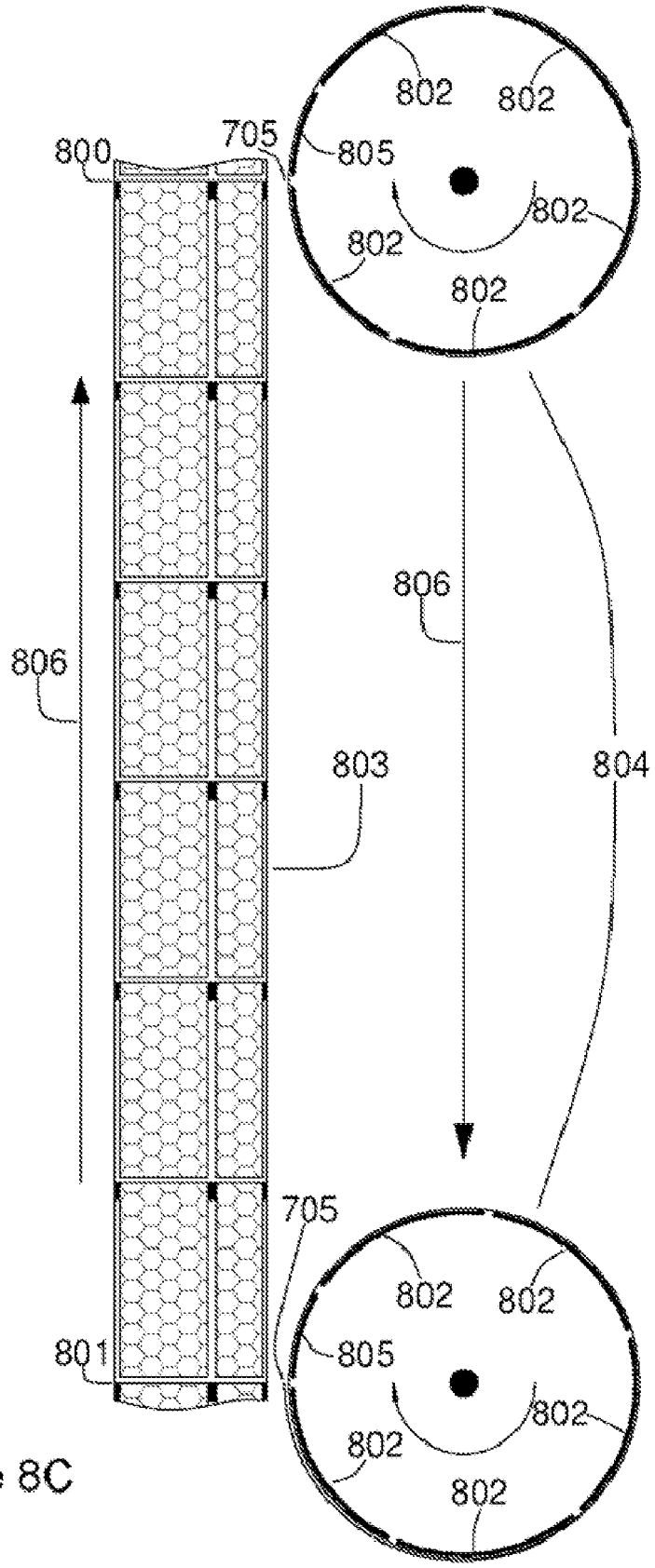
FIG. 8C is an illustration of a non-exact size image roll which has a slower surface speed than the expiring roll speed in accordance with an embodiment of the disclosure.

FIG. 8C illustrate the concept of phase lock speed. In a particular embodiment, the 5.5 image circumference roll is 91.67% of the circumference of an exactly 6 image circumference roll. By turning the 5.5 image roll at 91.67% of the speed of the expiring material we can maintain alignment between the leading edge of the new roll of material and every sixth image on the expiring roll of material.

Figure 9:
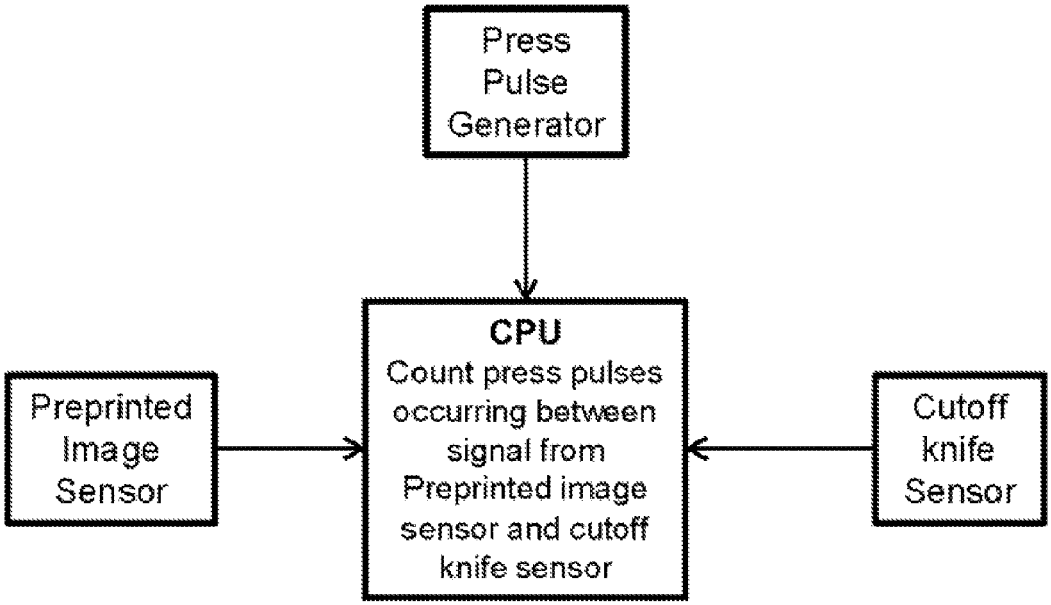
FIG. 9 is flow chart comprising a portion of the information flowing between some sensors and a Central Processing Unit in accordance with an embodiment of the disclosure.

FIG. 9 illustrates an embodiment of the flow of some of the information into CPU. CPU can receive signals from a preprinted image sensor which can be used to calculate the speed and position of the preprinted image relative to the moving components of the press. A CPU can also receive signals from a press pulse generator. A press pulse generator can include digital or analogue signals which can be generated by the passing of fine toothed gears passing by an electromagnetic sensor. A CPU can also receive information from sensors on the cutoff cylinder which would indicate the position of the cutoff knife.

Figure 10:
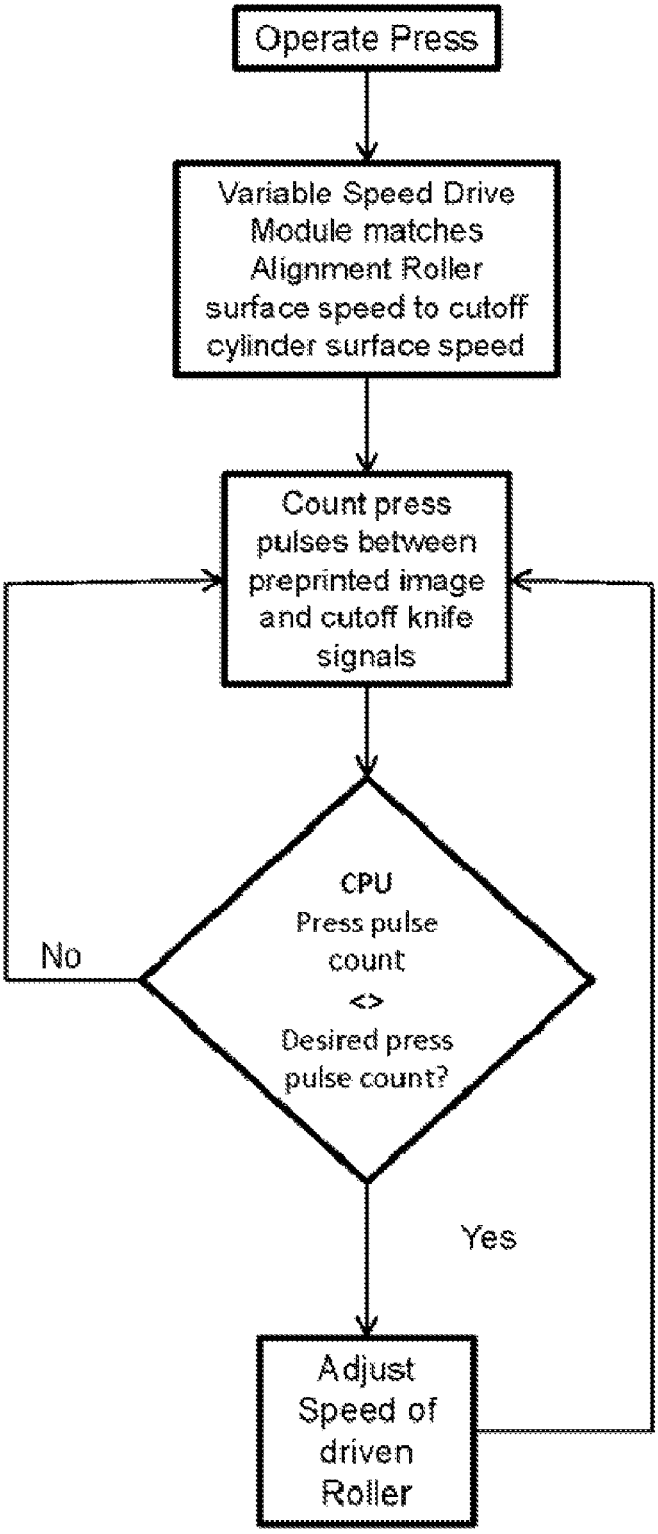
FIG. 10 is a flow chart comprising a portion of a logic tree for a pasting process in accordance with an embodiment of the disclosure.

FIG. 10 illustrates a flow chart of a potential embodiment of the disclosure. Press operation can include operating or running the press. As the press is running, a Variable Speed Drive Module matches the surface speed of an Alignment Roller to the surface speed of the cutoff cylinder. A CPU can receive signals which can assist in the determination of where a preprinted image is relative to a cutoff knife. A CPU can count the press pulses between the passing of a preprinted image across a sensor and the passing of the cutoff cylinder across another sensor. If the measured number of press pulses between those two events is outside of an allowable tolerance of desired press pulses, a CPU can communicate a signal to the Alignment Roller, or driven roller, to modify the position of the preprinted image relative to the position of the cutoff cylinder.

One feature of at least some of the foregoing embodiments is to achieve the same speed and position relationship of the images of a preprinted roll of substrate to the speed and position of the press cutoff rollers 108 as the images that would be created by the printing cylinders 105 of the same web path followed by the preprinted material on the resident printing press. By holding this speed and position relationship constant, the press operators can be able to achieve alignment of the preprinted material to the rest of the final product of the resident press by means of the existing compensation and registration controls of the press. The ACS uses the various speed and position feedback signals to align the preprinted images to the cutoff rollers 105.

Another feature of at least some of the foregoing embodiments is to automatically adjust the electronic line shaft gear ratio of the Alignment Roller 308 to correct for variations in preprinted material repeat intervals.

Still another feature of at least some of the foregoing embodiments is to achieve pasting of new rolls of preprinted material to expiring rolls of preprinted material with the images on the two substrates in alignment with each other.

Yet another feature of at least some of the foregoing embodiments is to generate an alerting indication to press operators that the system has achieved alignment of the preprinted images to the cutoff cylinder and communicate to the operator may go ahead and use the resident printing press compensation and registration controls to include the preprinted material in the finished product.

Yet another feature of at least some of the foregoing embodiments is to maximize the rate of preprinted material position correction in the event of any deviation from alignment.

Yet another feature of at least some of the foregoing embodiments is to provide as little departure as possible from normal press operation due to the use of the ACS.

Yet another feature of at least some of the foregoing embodiments is to provide the ability to turn off or disconnect the virtual origin control system and leave the press in a totally normal operational state.

Yet another feature of at least some of the foregoing embodiments is to be able to adapt the ACS to operate with any existing web printing press.

From the foregoing, it will be appreciated that specific embodiments of the disclosure have been described herein for purposes of illustration, but that various modifications may be made without deviating from the disclosure. For example, the disclosed sensors may have different arrangements and/or configurations in other embodiments. The Alignment Roller can be a new unit added to a press or a roller which is already installed on a press may be modified to perform the functions of an Alignment Roller. Examples of existing rollers which could perform the functions of an Alignment roller are an outfeed roller or a print roller.

Certain aspects of the disclosure described in the context of particular embodiments may be combined or eliminated in other embodiments. Further, while advantages associated with certain embodiments have been described in the context of those embodiments, other embodiments may also include such advantages, and not all embodiments need necessarily exhibit such advantages to fall within the scope of the present disclosure. Accordingly, the disclosure can encompass other embodiments not expressly shown or described herein.

We claim:

1. A method of creating a roll of preprinted images with an equivalent cutoff which is greater than the cutoff of the press which is creating the preprinted images comprising:

providing a web press with print cylinders operating at a print cylinder surface velocity; and providing a roll of substrate; and creating a web by threading said roll of substrate through the web press; and printing images on the web with said print cylinders; and said images have a first cutoff length; and providing a set of rollers subsequent to print units; and operating said rollers at a roller surface velocity which is greater than said print cylinder surface velocity; and running said web of preprinted images through said rollers; and stretching said web with said rollers creating a web of stretched preprinted images; and said web of stretched preprinted images has an equivalent cutoff which is greater than said first cutoff length; and rerolling said web of stretched preprinted images.

2. A method of creating a newspaper comprising:

providing a first web press with print cylinders operating at a print cylinder surface velocity; and providing a roll of high quality substrate; and creating a high quality web by threading said roll of high quality substrate through the web press; and printing images on the high quality web with said print cylinders; and said images have a first cutoff length; and providing a set of rollers subsequent to said print units; and operating said rollers at a roller surface velocity which is greater than said print cylinder surface velocity; and running said high quality web of preprinted images through said rollers; and stretching said high quality web with said rollers creating a high quality web of stretched preprinted images; and said high quality web of stretched preprinted images comprising an equivalent cutoff which is greater than said first cutoff length; and rerolling said high quality web of stretched preprinted images; and creating a second high quality web of preprinted images by threading said high quality web of stretched preprinted images into a second web press; and operating said second web press to create a newspaper.

* * * * *